United States Patent [19]

Karp

[11] Patent Number: 4,626,313

[45] Date of Patent: Dec. 2, 1986

[54] MANUAL LABEL APPLICATOR

[75] Inventor: Edward C. Karp, Belvidere, Ill.

[73] Assignee: Sanitary Scale Company, Belvidere, Ill.

[21] Appl. No.: 688,179

[22] Filed: Jan. 2, 1985

[51] Int. Cl.[4] ..... B65C 9/18; B65C 9/42

[52] U.S. Cl. ..... 156/362; 156/541; 156/584; 156/DIG. 33; 156/DIG. 45; 221/22; 221/73; 226/88; 271/188

[58] Field of Search ..... 156/584, 541, 465, 362, 156/DIG. 33, DIG. 45; 221/73, 22; 226/88; 271/188

[56] References Cited

U.S. PATENT DOCUMENTS

| | | | |
|---|---|---|---|
| 3,077,919 | 2/1963 | Krueger | 156/584 |
| 3,169,895 | 2/1965 | Sohn | 156/584 |
| 4,059,203 | 11/1977 | Wright | 221/73 |
| 4,402,424 | 9/1983 | Mattix | 156/584 |
| 4,414,054 | 11/1983 | Becker et al. | 156/584 |

*Primary Examiner*—Michael Wityshyn

*Attorney, Agent, or Firm*—Cook, Wetzel & Egan, Ltd.

[57] ABSTRACT

A manual label applicator is provided for use in a commodity weighing and labeling station. As a preprinted label is advanced from a printing station in a cantilever fashion, a label applicator having a roll with knife edges thereon causes said label to be creased in the direction of travel. Creasing of the label tends to keep it rigid and reliably hold it in a orientation suitable for manual application either through impact or by physically removing the label by hand. The knife edges or ridges on the roll further cooperate with fluting provided in a sliding surface for facilitating the partial creasing of the label as it advances through the label applicator.

15 Claims, 4 Drawing Figures

MANUAL LABEL APPLICATOR

BACKGROUND OF THE INVENTION

The present invention relates generally to the commodity packaging and handling art. More particularly, the present invention invention is directed to an improved label applicator for manually applying printed labels from a label printer to a weighed commodity.

Integrated weighing and labeling stations for high-speed processing of commodities in supermarkets and commodity processing plants are well known in the art. An example of such a system with the additional features of a full-screen display of the label to be printed and inventory control is shown generally in U.S. Pat. No. 4,398,253, by Karp, et al., issued Aug. 9, 1983 and assigned to Sanitary Scale Company. Such high-speed systems typically utilize an automated label applicator for adhering a printed label to a commodity. One such applicator is shown generally in U.S. Pat. No. 4,367,118, by Karp, issued Jan. 4, 1983, and assigned to Sanitary Scale Company. Another example of a high-speed label applicator is illustrated in copending U.S. application Ser. No. 649,618, by Karp, filed Sept. 12, 1984 and entitled Automated One-Stroke Label Applicator.

However, in smaller volume applications utilizing slower speeds for the overall wrapping, weighing and labeling process, manual label applicators have typically been utilized. Such systems are generally similar to the high-speed systems in that the commodity is weighed by a scale and a corresponding label is printed indicating the commodity's total price and weight with such other information as may be desired. In such systems, the commodity is typically moved from position to position at the wrapping, weighing and labeling station manually by the station operator. Similarly, the label is typically extruded or ejected at a fixed station and then manually applied to the commodity by the operator.

In the manual label applicator situation, it is desirable for the printed label to be maintained in a desired orientation to readily facilitate application of the label to the commodity with a minimum of effort by the station operator. In this context, the label may be ejected to be snatched by the operator with her fingers and applied manually to the commodity. Alternatively, the label may be extruded with its printed side positioned against a strike plate or wiping surface, thus exposing its adhesive side for application to the commodity by either striking the commodity against the strike plate or "wiping" the commodity across a surface to cause the label to adhere to the commodity. The label may then be further secured by the operator to conform the label to any irregular contours in the commodity. In this latter method, the station operator's hands and fingers generally remain free of adhesive which is desirable during wrapping and weighing.

Several methods have been utilized in the prior art to attempt to maintain and to positively retain the printed label in the desired applicating orientation after it is extruded from the print unit. In one such method a partial vacuum is created to seize and retain the label against an angled arcuate plate surface until it is manually removed. Typically, a fan pulls the air through a number of holes in the plate surface to create a partial vacuum which sucks the non-adhesive side of the label against the plate to retain it and position it for the station operator. The labels as extruded from the print mechanism may not, however, be sufficiently rigid or planar so as always to engage the surface of the vacuum plate, thus causing the label to droop out of the normal applicating position and on occasion permitting the label to fall away and be lost. Since these systems are required to maintain an accurate accounting of items processed, label loss can cause unacceptable errors in this accounting.

Further, because the vacuum plate is typically located immediately adjacent the print head, air movement created by the fan tends to cool the print unit. This is particularly undesirable when a thermal printing unit is utilized because the labels will not be printed at all if the print head is cooled too much and print head operation may be affected if the head must be heated to compensate. The typical refrigerated environment of most commodity packaging areas aggravates this problem.

A second method has involved the addition of a roller which is positioned slightly (approximately ⅛" in many applications) below an arcuate vacuum plate and is designed to support and help retain those labels which, when cantilevered from the printer, because of droop or other planar distortion, are not effectively seized and held against the vacuum plate by the vacuum or vacuum engendered air stream. This method may again, generally be acceptable when the label contains a sufficiently rigid composit and is essentially planar as issued. Even the use of such a roller may be unsatisfactory over a range of label stiffness and with planar variations. It fails to positively assure label retention or effectively maintain the label in optimum applicating position.

Both of these methods suffer from the drawbacks previously discussed, e.g. use of elaborate vacuum arrangements and lack of reliability in retaining the label in a position for ready application.

Accordingly, it is desirable to provide a manual label applicator unit which allows for easy application, requires a minimum of manipulation of the label by the station operator, readily and reliably accepts, processes and retains all types of labels having various label consistencies and stiffness and interfaces with the label printing unit without adversely affecting the performance of the printing unit. Therefore, the principal object of the present invention is to provide a manual label applicator which generally overcomes the deficiencies in the prior art.

It is a further object of the present invention to provide a manual label applicator which presents a preprinted label in a desired position for manual application to a desired commodity.

It is still a further object of the present invention to provide a manual label applicator which maintains a preprinted label with its adhesive side exposed and its nonadhesive side substantially in contact with a strike plate to allow ready application of the label to a desired commodity.

SUMMARY OF THE INVENTION

The present invention provides a label applicator for receiving a label having an adhesive side and presenting the label in a condition acceptable for manual application. The manual label applicator of the present invention generally comprises a frame with a roller mounted therein. The roller has at least one knife-edge ridge running transversely to its rotating axis and adapted to contact the adhesive side of the label as it is received from a printing unit. The ridge on the roller causes a partial creasing of the label thereby causing it to be maintained in an approximately planar orientation. The frame may further comprise an essentially smooth striking surface against which the label may be impacted by the station operator to cause it to adhere to a desired commodity. It is envisioned that the roller and its ridge would be positioned so as to cause the non-adhesive side of the label to contact the strike surface as the label advances through the applicator in a relatively flat condition. Further, fluting or grooves may be included in the frame surface to interact with the ridges on the roller.

Additionally, the ridges on the roller may be of sufficient height to partially overlap the sliding surface in the area of its grooves to further urge the label to be partially creased. Also, the roller may comprise a sufficiently low friction substance to reduce binding and adhesion by the label as it passes through the applicator.

BRIEF DESCRIPTION OF THE FIGURES

The subject matter of the present invention is set forth distinctly and with particularity in the appended claims. However, the invention may be further understood when the claims are taken in reference to and in conjunction with the following written description and the accompanying drawings in which like elements are identified by like reference numerals and of which:

DETAILED DESCRIPTION OF THE INVENTION

Figure 1:
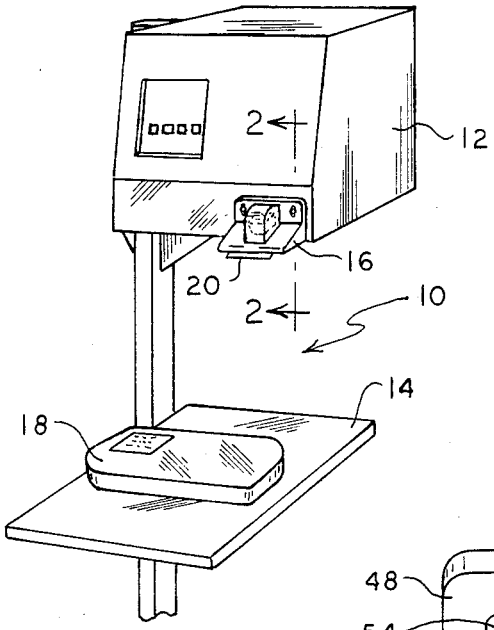
FIG. 1 is an isometric view illustrating a commodity labeling station with the manual label applicator of the present invention attached to a printing unit.

The details of the present invention may be more fully understood by reference to the accompanying drawings. Referring now to FIG. 1, therein is shown a manual label applicating station as may be used in a commercial environment. The station 10 typically comprises a printing unit 12, a work table 14 and a label applicator 16. In operation, a weighed commodity 18 is transferred to the table 14 by the station operator and an appropriate printed label 20 is ejected by the printing unit 12 and held for application by the label applicator 16. The station operator may then apply label 20 to the commodity 18.

Application of label 20 to commodity 18 may be accomplished in several ways. One method is for the station operator to physically remove label 20 with his fingers from label applicator 16 and apply it to commodity 18 as it lies on table 14 or is held in his other hand. A second method for applying label 20 to the commodity 18 involves rubbing or wiping the commodity 18 across the front edge of label applicator 16 to engage the adhesive side of label 20, which is facing downward, causing the label 20 to adhere to the commodity 18. The label may then be further smoothed by the station operator to conform to the possibly irregular contours of the commodity 18. Alternatively, the commodity 18 may be flipped to cause its essentially flat bottom to impact on the front edge of label applicator 16 to initially adhere label 20 to the bottom of commodity 18. Commodity 18 may then be "wiped" across label applicator 16 to cause the label 20 to adhere to the generally flat bottom of the commodity package.

Figure 2:
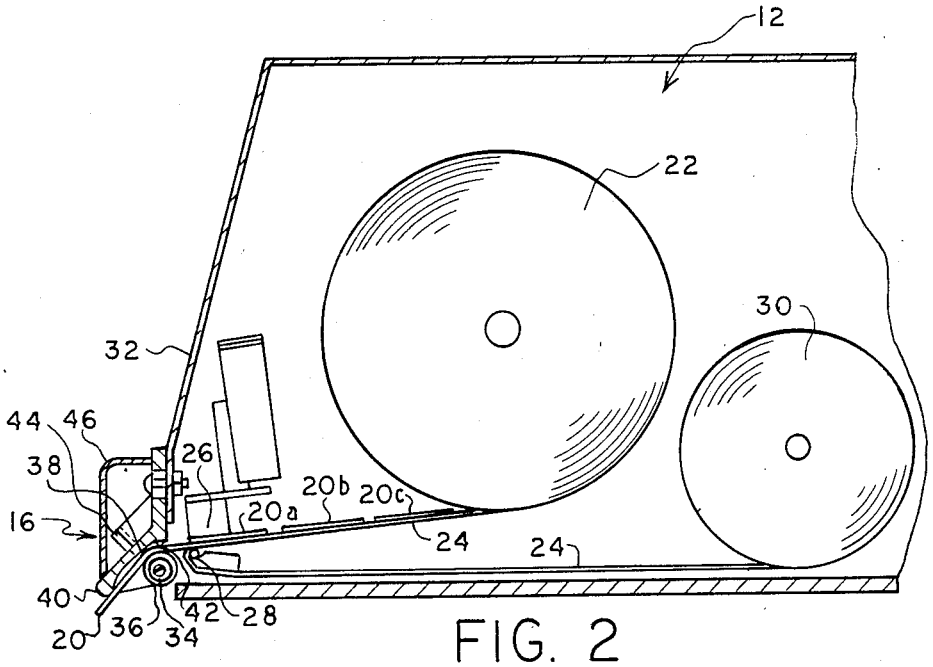
FIG. 2 is a cross-sectional view of the printing unit of FIG. 1 with the manual label applicator of the present invention attached thereto as seen along the view line 2—2 of FIG. 1.

Referring now to FIG. 2, therein is shown a cross-sectional view of the label applicator 16 and the printer 12. Generally, the printing unit 12 comprises a roll 22 of labels 20, 20*a*, 20*b*, 20*c* and so on, each removably carried on a continuous backing sheet 24. As the labels 20 are advanced to a printing station 26, they are printed with the appropriate information such as total weight, total price, price per pound, name of the commodity to be labeled, etc. After the label 20 has been printed at printing station 26, the backing sheet 24 is pulled across a breaker bar 28 which causes the label 20 to separate from the backing sheet 24 which is taken up on a take-up roll 30. The breaker bar 28 causes the label 20 to be removed from backing sheet 24, because it bends the sheet containing the label about a sufficiently acute angle that the greater stiffness of the label (when compared to the stiffness of the backing sheet 24) and the lack of adhesion between the label 20 and the backing sheet 24 causes the label to be ejected in a generally horizontal cantilever fashion from housing 32 of the printing unit 12.

When the printed label 20 is ejected from the housing 32 of the printing unit 12 in a cantilever fashion, it contacts the label applicator 16. As the label 20 engages the label applicator 16, it also contacts a guide roll 34 having one or more ridges or knife edges 36 thereon. The ridges 36 force the label 20 against an upper slide surface 38 of label applicator 16. In the preferred embodiment of the present invention, the ridges 36 on roller 34 cause the label 20 to become partially creased to give it an increased stiffness along its length in its direction of travel through applicator 16 to maintain it generally flush against upper surface 38. In effect, the ridges 36 of roller 34 give the label a somewhat "corrugated" rigidity which tends to inhibit the label's natural tendency to droop.

Although the label does tend to be somewhat "creased" by the knife edges on the roll 34, it is not permanently distorted. The label is slightly stressed so as to retain it for ready application. Also, in the preferred embodiment, three ridges 36 are formed on the roll 34. With the use of three such ridges, any stiffness label may be accommodated without the adhesive side of the label contacting the main body of roll 34. The three ridges 36 sufficiently stress or "crease" the label 20 so as to retain it for application, while also minimizing the amount of contact between the label and the roll so as the minimize the tendency of the label to wrap around roll 34.

As the label 20 progresses further through label applicator 16 through the cantilever projection from printing unit 12, the leading edge of label 20 will eventually come to rest approximately coincident with the front lip or surface 40 of label applicator 16. At that time, because of the corrugated rigidity introduced in label 20 by the ridges 36 of roller 34, the label will be generally against the front lip 40 for ready application by the station operator to the commodity 18 by any of the methods explained above.

In the preferred embodiment of the present invention, the upper guide surface (sliding surface) 38 may further include fluting sections 42 which may be milled into the surface 38 and operationally aligned with the ridges 36 of roller 34. The fluting sections (grooves) 42 further enhance the corrugating effect of the knife edges 36. Further, the ridges 36 of roller 34 may extend partially into the fluting areas 42, e.g., approximately three to five thousandth of an inch.

Also, in the preferred embodiment of the present invention, the label applicator 16 may include a label sensor 44 which may be positioned above a hole in surface 38 to sense whether a label is in position for application and accordingly stop the take-up roll 30 from advancing another label 20a into label applicator 16 until the initial label 20 has been removed. Label applicator 16 may further include a preformed plastic housing 46 for the label sensor 44 to protect it from the ambient environment.

Figure 3:
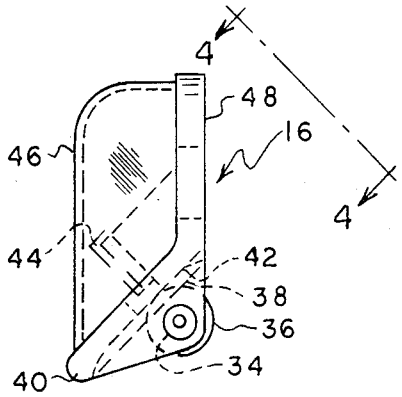
FIG. 3 is a side view of the manual labor applicator of the present invention.

Referring now to FIG. 3, therein is illustrated a side view of the label applicator 16. In this view, the protective cover 46 is shown in greater detail. Also shown in outline form is the label sensor 44. FIG. 3 illustrates the relative desired positioning of the label sensor 44 and the roller 34. It can be seen from this alignment that the label sensor 44 will sense a label after it has contacted the roller 34 and the sliding surface 38.

FIG. 3 also serves to illustrate the interrelationship of the roll 34, the ridges 36, the sliding surface 38 (shown in outline) and the flutting grooves 42 (shown in outline). It can be seen that as a label 20 advances and contacts a ridge 36 of roller 34 causing it to rotate and further advance the label through the label applicator 16, the ridge 36 will tend to force the label to crease slightly as it is forced along the sliding surface 36 and into the fluting areas 42. In this context, it can be seen that the ridge 36 of roller 34 overlaps the sliding surface 38 in the fluting areas 42 by approximately three to five thousandth of an inch as mentioned above.

FIG. 3 further shows the preferred mounting angle for label applicator 16. In the illustrated embodiment, a back surface 48 may be mounted flush against a printing unit 12. Accordingly, as the label 20 is extruded in a cantilever fashion from the printing unit 12 it will be forced between the roller 34 and the sliding surface 38 and advanced in a slightly downward angle.

Application of the label to a commodity is further facilitated by the surface 40 as shown in FIG. 3. In the illustrated embodiment, surface 40 comprises a smooth and rounded lip at the forward end of label applicator 16. Although shown in a desired configuration, surface 40 may be replaced by any desired striking surface or perhaps a sponge-like material to further facilitate the initial application of the label to the commodity. In the preferred embodiment, surface 40 is a rounded and smooth surface to facilitate a "wiping" application of the label to the commodity.

Figure 4:
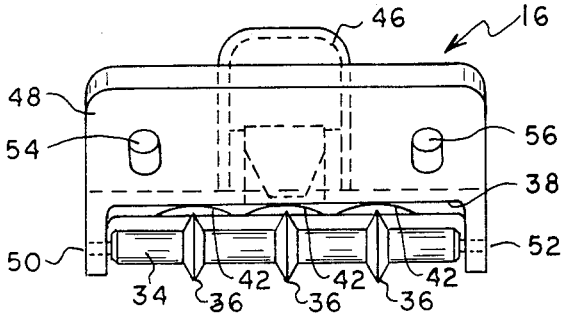
FIG. 4 is a rear view of the manual labor applicator of the present invention as seen along the view line 4—4 in FIG. 3.

Referring now to FIG. 4, therein is shown a rear view of label applicator 16 along the view line 4—4 illustrated in FIG. 3. FIG. 4 more particularly illustrates the roller 34 with ridges 36 thereon. As shown, ridges 36 may typically comprise relatively sharp knife edges extending circumferentially around roller 34. Only the tip of the ridge is desired to contact the label 20 as it is cantilevered from the printing unit 12. Because ridge 36 contacts the adesive side of the label, it is desirable to minimize the area of the roller which actually contacts the adhesive. Accordingly, the ridges 36 are each milled or formed to a knife edge. Also, to further minimize contact, the ridges 36 are relatively pointed. In the preferred embodiment of present invention, the included angle formed by the knife edge is approximately sixty degrees.

The roller 34 is carried in the frame of label applicator 16 by pins 50 and 52. It is desired that the roller 34 be mounted on pins 50 and 52 to allow it to rotate freely when contacted by the label 20.

Further illustrated in FIG. 4 are mounting holes 54 and 56 in back wall 48 of label applicator 16. Mounting holes 54 and 56 illustrate one suitable method for mounting the label applicator 16 on the desired printing unit 12. In the preferred embodiment, the holes are generally oval to allow accurate vertical positioning of label applicator 16.

The label applicator of the preferred embodiment of the present invention is designed to be readily utilized with labels of various stiffnesses and consistency. In that regard, the amount of overlap between the knife edge 36 and the sliding surface 38 in the fluting areas 42 has successfully been found to be approximately three to five thousandth of an inch. This may be varied by using a larger diameter ridges on roller 34 or by repositioning the mounting pins 50 and 52 in the frame of label applicator 16.

It is also envisioned that label applicator 16 of the present invention may be readily utilized with labels of varying dimensions. However, it is desirable that the length of surface 38 in the direction of travel of label 20 would be slightly shorter than the length of the label 20. This would allow the tip of label 20 to extend slightly beyond surface 40 when the label is in an orientation desired for manual application. This is illustrated in Figure 1. Also, it is desirable that the width of surface 38 as shown in FIG. 4 (approximately equal to the length of roller 34) be somewhat greater than the width dimension of the label 20. While this dimension must be greater than the width of the label to allow the label to pass, it is also desirable to maintain some degree of correlation between the width of the labels to be used and the width of the opening defined by surface 38. This insures that the label will be maintained in a desired orientation as it advances through the label applicator 16. If the width dimension of sliding surface 38 were to be made too much larger than the width dimension of the label 20, it is possible that the label 20 would become skewed or angled sideways as it advances through the label applicator 16 which may cause it to bind or to become wrapped around the roller 34.

It is envisioned that the label applicator of the present invention may be constructed of any suitable materials. In the preferred embodiment of the present invention, the frame of label applicator 16 may be constructed from milled or cast aluminum with the pins 50 and 52 being mounted freely in holes drilled therein. However, the frame may also be constructed to molded plastic or other sufficiently rigid material. Also, the roll 34 and the ridges 36 may be constructed of any suitable low friction material, for example nylon or Teflon. Attentatively, a different substance may be used to form the body of the roll 34 and ridges 36 with a coating of sufficiently non-sticking material placed over the other material. Use of material such as this minimizes the degree of adhesion between the roller 34 and the ridges 36 mounted thereon and the adhesive side of the label as it is advanced through the label applicator 16.

As mentioned above, it is envisioned that the present label applicator may be readily utilized with labels of varying consistencies, differing adhesives and multiple dimensions. The use of the interacting sliding surface with fluting and the roller bar with ridges allows the present invention to be utilized in differing humidity environments and still adequately prevent curling of the label either longitudinally or laterally.

Although described above in terms of several preferred embodiments of the present invention, the scope of the present invention is set forth with particularity in the appended claims. However, such changes and modifications as would be apparent to one skilled in the art and familiar with the teachings of the present application are deemed to fall within the spirit and scope of the present invention.

What is claimed is:

1. A label applicator for receiving a preprinted label, having a printed side and an adhesive side and presenting said label with said adhesive side at least partially exposed for applying said label to a commodity comprising:

a frame member;

a roll member rotatably mounted to said frame and having a plurality of ridges extending circumferentially around said roll member, said ridges being adapted to contact said adhesive side of said label as it is received; and a first surface defined in said frame having a corresponding plurality of generally longitudinal flutes defined therein, each said flute being in approximate vertical alignment with and arranged for partially receiving one of said plurality of ridges on said roll member to provide a plurality of partial creases in said label as it is advanced beyond said roll member to impart increased stiffness to said label along its length with said adhesive side at least partially exposed for applying said label to a commodity.

2. The label applicator of claim 1 wherein said first surface extends beyond said roll member and said printed side of said label is maintained substantially adjacent said first surface whereby said partially exposed adhesive side of said label may be applied to a commodity by impacting said commodity against said first surface.

3. A label applicator for receiving a preprinted label having a printed side and an adhesive side in a cantilever fashion and presenting said label for manual application comprising:

a substantially smooth impact surface to allow manual impacting of a commodity;

a roll member having a plurality of ridges thereon and being free to rotate as said label is received in a cantilever fashion;

a sliding surface having a corresponding plurality of grooves therein, each said groove being in cooperative alignment with one of said ridges;

said ridges on said roll member having a radius slightly greater than the separation between the axis of said roll member and said sliding surface;

an input port defined by said roll member and said sliding surface, said adhesive side of said label contacting said roll member and said printed side of said label contacting said sliding surface as said label is received in a cantilever fashion, whereby said label tends to be at least partially creased as it advances between said roll member and said sliding surface and is presented substantially flush against said impact surface for application to a commodity.

4. The label applicator of claim 3 wherein the radii of said ridges are greater than the separation between the axis of said roll member and said sliding surface by a difference of approximately 4 mils.

5. The label applicator of claim 3 wherein said roll is coated with a substantially adhesive resistant material to minimize adhesion between said adhesive side of said label and said roll member.

6. The label applicator of claim 5 wherein said adhesive resistant material is plastic.

7. The label applicator of claim 3 wherein said roll member has at least three ridges mounted thereon and said sliding surface has at least three grooves in cooperative alignment with said three ridges.

8. The label applicator of claim 7 further including:

detection means responsive to said label being presented for application.

9. The label applicator of claim 3 wherein the included angle of said ridges on said roll member is approximately sixty degrees.

10. A label applicator for receiving a label having an adhesive side and presenting said label in a condition acceptable for manual application comprising:

a frame member;

a roll member having a plurality of ridge members extending circumferentially about said roll member, said roll member being mounted in said frame and said ridge members being adapted to contact said label as it is received;

said frame member further comprising a first surface having a corresponding plurality of grooves therein in general alignment with said ridge members on said roll member, each said ridge member overlapping said first surface in the areas of said grooves whereby said label tends to be at least partially creased by the cooperation of said grooves and said ridge members as said label advances through said frame; and said frame further comprising a substantially smooth surface to adhere said label to a manually impacted commodity.

11. The label applicator of claim 10 wherein said roll member is free rolling.

12. The label applicator of claim 10 wherein each said ridge member comprises a knife edge having an included angle of approximately sixty degrees.

13. The label applicator of claim 10 wherein said roll member is composed of adhesive resistant plastic material.

14. The label applicator of claim 10 wherein said roll member has three ridges and said first surface has three grooves in cooperative alignment with said three ridges.

15. The label applicator of claim 10 further including:

sensing means to sense said label as it passes beyond said roll member.

* * * * *

UNITED STATES PATENT AND TRADEMARK OFFICE

CERTIFICATE OF CORRECTION

PATENT NO. : 4,626,313

DATED : December 2, 1986

INVENTOR(S) : Edward G. Karp

It is certified that error appears in the above-identified patent and that said Letters Patent is hereby corrected as shown below:

Column 1, line 7, delete "invention" second occurrence; and

Column 8, line 9, after "roll" insert --member--.

Signed and Sealed this

Thirty-first Day of March, 1987

*Attest:*

DONALD J. QUIGG

*Attesting Officer*

*Commissioner of Patents and Trademarks*